US005520242A

United States Patent [19]

Streubel et al.

[11] Patent Number: 5,520,242

[45] Date of Patent: May 28, 1996

[54] METAL MOLD FOR CONTINUOUS CASTING OF STEEL BANDS

[75] Inventors: Hans Streubel, Erkrath; Horst Grothe, Kaarst, both of Germany

[73] Assignee: SMS Schloemann-Siemag AG, Düsseldorf, Germany

[21] Appl. No.: 359,092

[22] Filed: Dec. 19, 1994

[30] Foreign Application Priority Data

Dec. 17, 1993 [DE] Germany ..... 43 43 124.0

[51] Int. Cl.[6] ..... B22D 11/00; B22D 11/20

[52] U.S. Cl. ..... 114/418; 164/459

[58] Field of Search ..... 164/418, 459

[56] References Cited

U.S. PATENT DOCUMENTS 4,635,702 1/1987 Kolakowski et al. ..... 164/418
4,926,930 5/1990 Gay et al. ..... 164/418
4,955,428 9/1990 Schrewe ..... 164/418

FOREIGN PATENT DOCUMENTS 61-7046 1/1986 Japan ..... 164/418
1-284463 11/1989 Japan ..... 164/418
1690945 11/1991 U.S.S.R. ..... 164/418

*Primary Examiner*—Richard K. Seidel
*Assistant Examiner*—I.-H. Lin
*Attorney, Agent, or Firm*—Anderson Kill Olick & Oshinsky

[57] ABSTRACT

A metal mold for continous casting of steel bands and including wide side walls and opposite narrow side walls extending parallel to each other between the wide side walls, and displaceable toward each other and away from each other for adjusting a distance therebetween, with the wide side walls each having a concave arcuate portion defining a pouring region, and inclined surfaces on opposite sides of the concave arcuate portion.

5 Claims, 3 Drawing Sheets

METAL MOLD FOR CONTINUOUS CASTING OF STEEL BANDS

BACKGROUND OF THE INVENTION

The present invention relates to metal molds for continuous casting of steel bands and having wide side and narrow side walls, with the wide side walls having a funnel-shaped pouring region that reduces the size of the cast band toward the narrow side walls and in the pouring direction, and with the narrow side walls extending parallel to each other and being adjustably arranged between the wide side walls.

A metal mold of this type is disclosed in European Publication EP-B1 0 149 734. In order to prevent jamming of castings as a result of mold contraction, the wide side walls of the mold are formed with parallel wall portions extending sidewise of the pouring region and space a distance corresponding to the band thickness. The parallel side wall portions extend up to respective narrow side walls.

Because of this shape, forming of a trapezium-shaped solid formation in the region of the inclined wide side wall is avoided, and formation of a shell structure in the parallel region does not lead to jamming.

By displacing the narrow side walls in the parallel region, it is possible to change the width of a casting during the casting process. If casting of a workpiece with a larger thickness is required, the narrow side walls need be changed.

Another type of a metal mold, a continuous metal mold, is described in German Patent DE 35 01 422 C2. This mold has wide side walls and narrow side walls that converge in the casting or metal flow direction. The converging wide side walls bulge outwardly so that they have a larger radius at the inlet end than at the outlet end. At their ends directed to the narrow side walls, the wide side walls have flat locating surfaces which are abutted by flat counter surfaces of the narrow side walls.

The shape of the walls of this mold enables changing of a casting thickness during the casting process. However, to this end, it is necessary to displace the narrow side walls vertically, i.e., in a direction opposite to the casting direction. Further, when this continuous casting mold is used, the wedge-like shape of the casting and extending from the inlet end to the outlet end, results in occurrence of undesirable deformations, in particular, in the border region.

Accordingly, the object of the invention is a metal mold which provides for changing the thickness of a casting in a closed mold and for extraction of the casting, without deforming the narrow side walls and/or the casting border region.

SUMMARY OF THE INVENTION

This and other objects of the present invention, which will become apparent hereinafter, are achieved by providing wide side walls having a central concave arcuate wall section, which defines the funnel-shaped pouring region, and surfaces which extend from opposite ends of a respective concave arcuate wall portion toward the narrow side walls and are inclined in a direction toward the narrow side walls and which approach each other as they extend from opposite sides of the funnel-shaped pouring region toward respective narrow side walls.

The metal mold according to the instant invention permits (i) to obtain a casting with rectangular solidification of the cast shell on the band side edges, that is, essentially without the deformation of the edge region, which is unavoidable in the edge region, having a trapezium-or wedge-shaped shell of solid castings, and (ii) to change the thickness of the cast workpieces or castings in a closed mold, i.e., during the casting process. To this end, the wide side walls can be displaced, in a simple manner, toward or away from each other, for example, with a spindle drive.

In one of the embodiments, the inclined surfaces are connected to the concave arcuate wall portion, defining the pouring region, at tangent points which are arranged above one another in a direction transverse or inclined toward the casting direction.

With the tangent points arranged above one another in a direction inclined toward the casting direction, the width of the concave arcuate wall portion continuosly increases in the casting direction, and a larger pouring region opening is provided on the inlet side of the mold. Here, the size of the funnel-shaped opening is defined by a horizontal distance between the upper edge or the inlet end of the mold and the opposite smaller mold outlet.

In yet another embodiment of a metal mold according to the present invention, concave wall portions are provided between the inclined surfaces and concave arcuate wall portions. In other molds a turning point is provided in the mold, however, in this case, small radii, leading to a larger funnel-shaped opening, are obtained. This insures obtaining a solid casting with a favorable deformation ratio and a small elongation.

According to the present invention, the inclination angle of the inclined surfaces can reach 10°. By changing the inclination angle of the inclined surfaces, which are, as it has already been established above, are located adjacent to the concave arcuate wall section, the radius of the concave arcuate wall section can be changed. A greater inclination angle leads to a smaller radius of the concave arcuate portion and, thereby, to a larger funnel-shaped opening.

BRIEF DESCRIPTION OF THE DRAWINGS

The objects and features of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 2A:
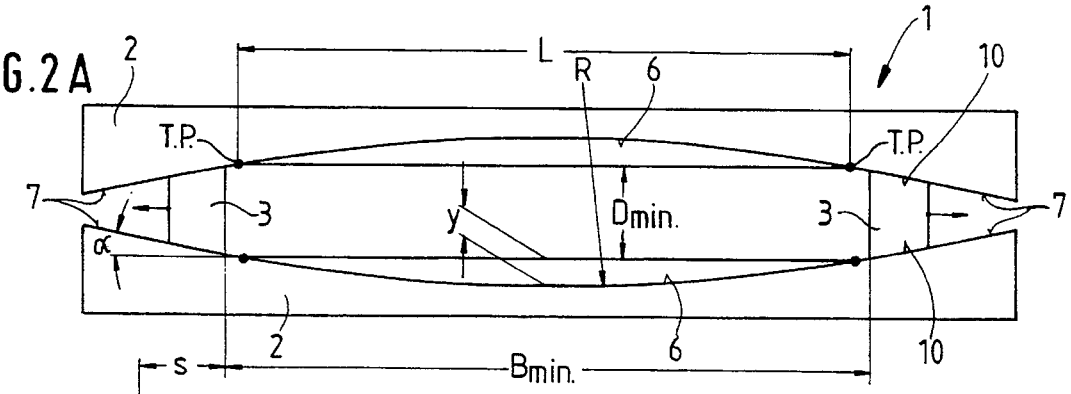
FIG. 2*a* is a top view of a metal mold having wide side walls shown in FIG. 1 and adjustable narrow side walls arranged between the wide side walls, with a smallest width and thickness.
Figure 2B:
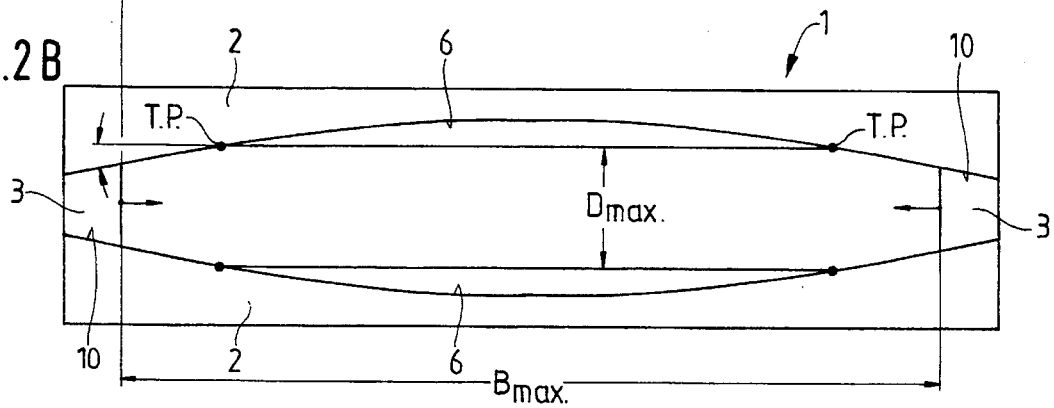
FIG. 2*b* is the same view as in FIG. 2*a*, but with a larger width and thickness.

FIGS. 2*a* and 2*b* show a metal mold 1 for casting thin slabs and consisting of two wide side walls 2, and two narrow side walls 3 which are arranged between the wide side walls 2 and are movable toward each other or away from each other.

Figure 1:
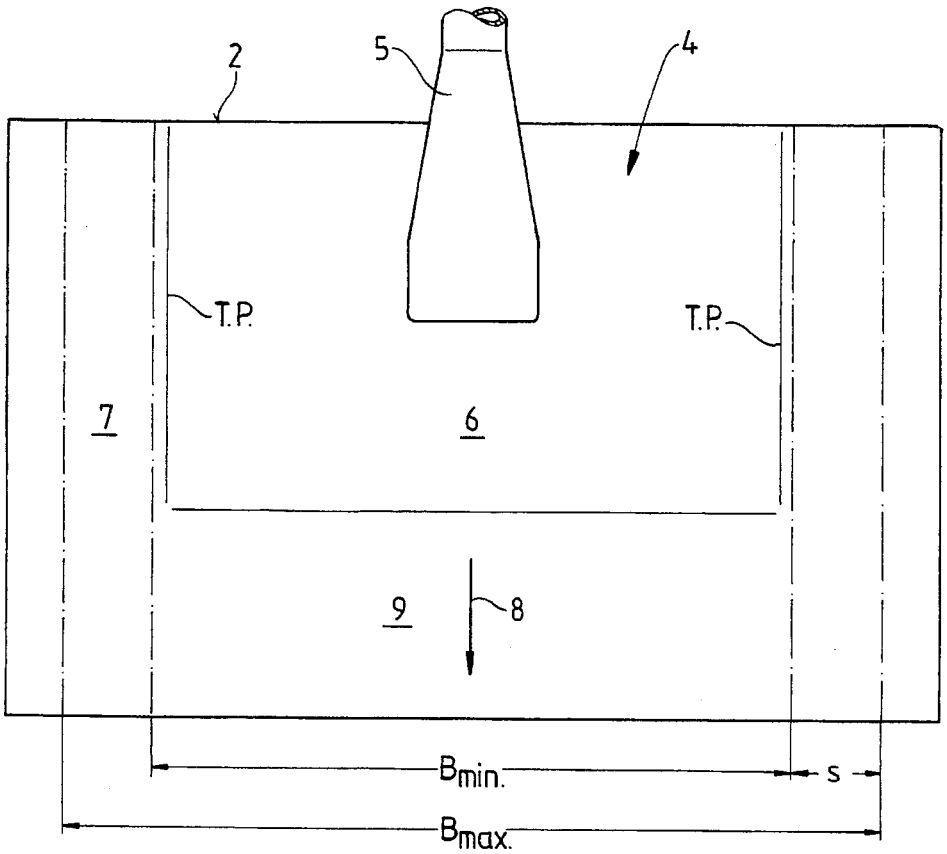
FIG. 1 is a front elevational view of a wide side wall of a continuous casting metal mold, according to the present invention, and having inclined surfaces at sides of its concave arcuate profile.

The wide side wall 2 has, as shown in FIG. 1, a funnel-shaped widened pouring region 4 into which a pouring spout 5 for admitting liquid steel, extends. The pouring region 4 is formed by a concave arcuate wall section 6 which occupies a portion of the mold height and the mold width, which is shown with inner thick lines.

At the sides, the pouring region 4 is limited by inclined surfaces 7 which are inclined toward the side edges at an angle $\alpha$ from lines defining a minimum width $B_{min}$. (FIGS. 2*a*, 2*b*), so that the wide side walls 2 approach each other in the region of the narrow walls 3 as clearly shown in FIGS. 2*a* and 2*b*. The wide side walls 2 extend in the casting direction 8 along the entire mold height, i.e., from the funnel opening to the outlet end of the metal mold.

Beneath the arcuate section 6, the mold has a straight section 9, the width of which corresponds to the minimal width $B_{min}$. The maximum outwardly adjustable position of the narrow side walls 3, with the adjustable path s of the narrow side wall being equal to the difference between $B_{min}$ and $B_{max}$.

The width and thickness of the cast workpieces, produced in the mold, can be changed by changing the space limited by the mold walls 2 and 3 by the adjustment or displacement of the narrow side walls 3 inward or outward. To this end, the narrow side walls 3 are provided with oppositely inclined surfaces 10 corresponding to the inclined surfaces 7 of the wide side walls 2. The minimum width $B_{min}$ and, thus, the minimum thickness $D_{min}$ of the mold are shown in FIG. 2*a*.

When the narrow side walls 3 are displaced from their position shown by arrows, the width and the thickness are respectively progressively increased reaching respective maximum values $B_{max}$ and $D_{max}$, as can be seen in FIG. 2*b*, when the narrow side walls 3 are in their maximum outward positions.

The distance between the tangent points T.P. is designated with L. In this embodiment, the tangent points T.P. lie beneath each other or above each other in a direction transverse to the cast direction and coincide with the outer side limits of the arcuate section 6 of the wide side wall (see FIG. 1).

As shown in FIG. 2*a*, and thus is applicable to other embodiments, the outer edge of the funnel-shaped pouring region 4 or, otherwise, the concave arcuate section 6 has a radius R which defines the size y of the funnel-shaped opening. The size y of the funnel-shaped opening 4 can be changed by changing the inclination angle $\alpha$ of the inclined surfaces 7. The angle $\alpha$ can attain 10°, and the greater the angle $\alpha$ is for a pre-determined width, the smaller is the radius R of the pouring region.

Figure 3:
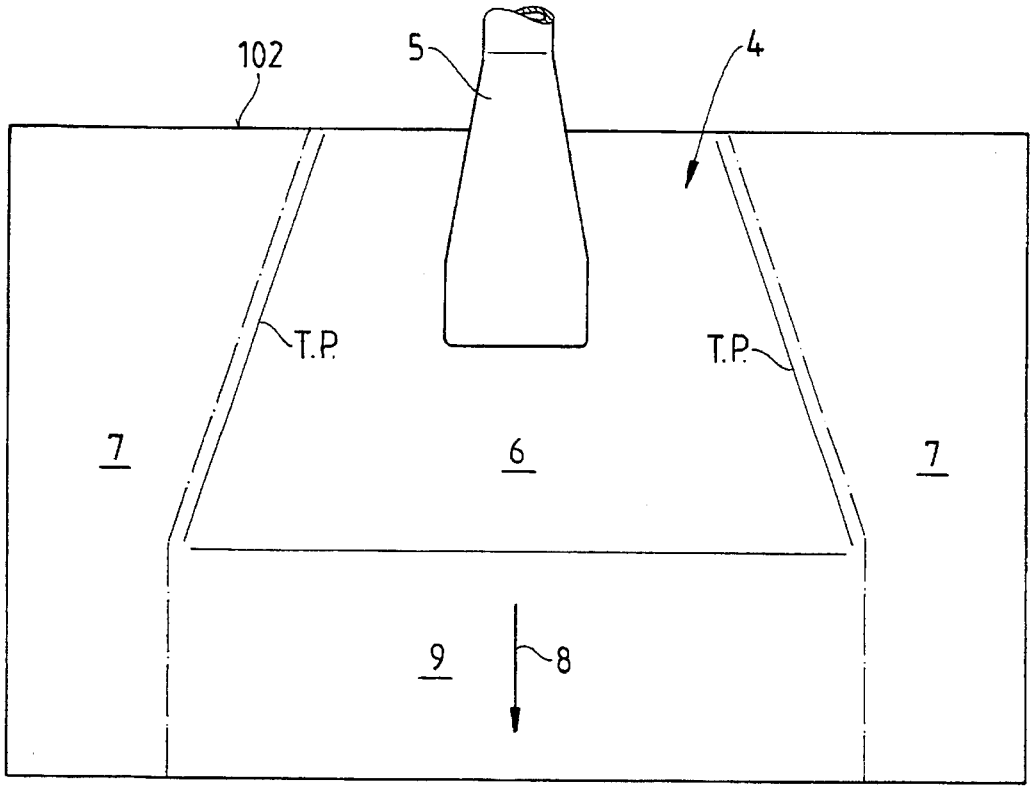
FIG. 3 is a front view of a wide side wall corresponding to that of FIG. 1, but with the inclined surfaces of the concave arcuate profile being inclined from top to bottom.
Figure 4:
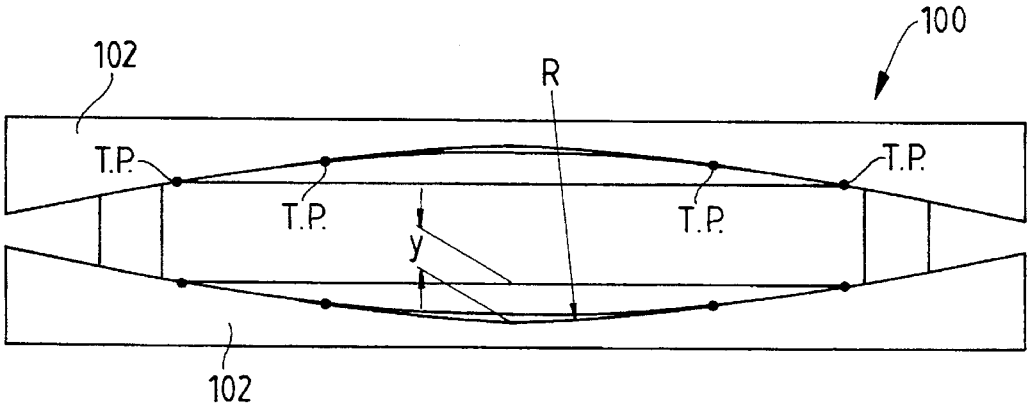
FIG. 4 is a top view of a metal mold having a wide side wall shown in FIG. 3.

The wide side wall 102, shown in FIG. 3, and the metal mold 100, shown in FIG. 4, differ from the wide side wall 2 shown in FIGS. 1 and 2, in that the inclined surfaces 7 thereof are inclined in the casting direction 8, that is, from top to bottom, and define lying above or beneath one another additional tangent points which limit the width of the convex arcuate section 6. With the wide side wall according to this embodiment, the funnel opening size y can be increased.

Figure 5:
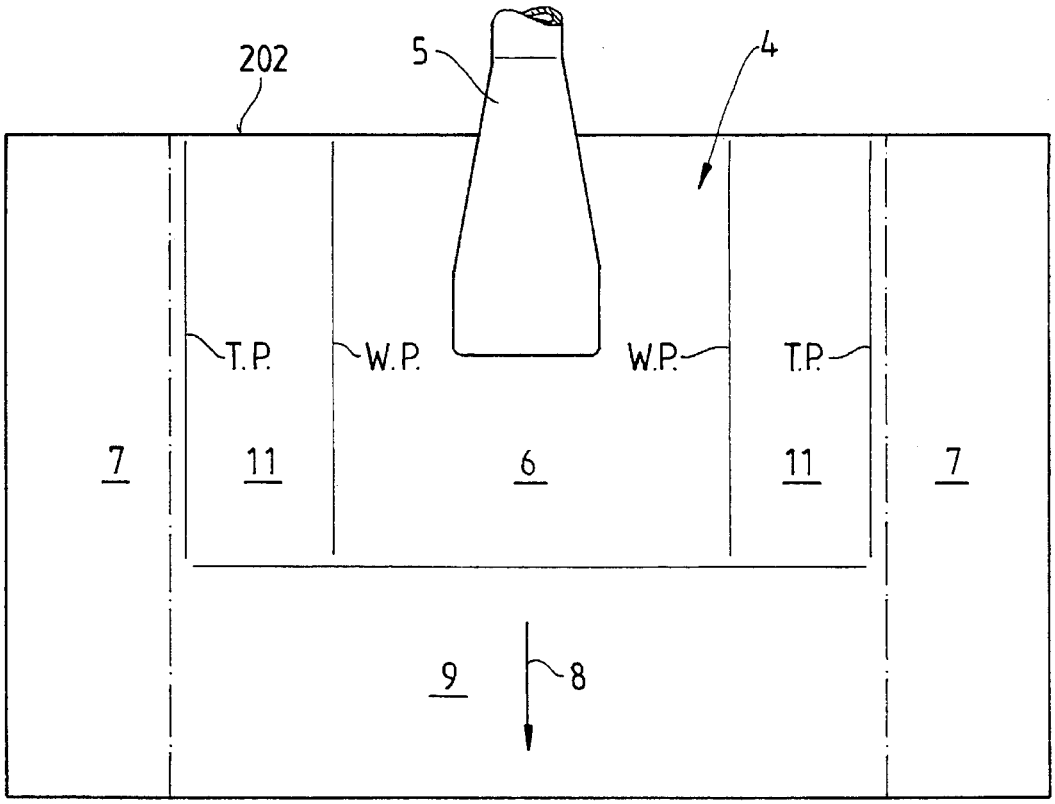
FIG. 5 is a front view of another embodiment of a wide side wall of a metal mold according to the present invention, and having concavely bent wall portions provided between the inclined surfaces and the concave arcuate profile of the funnel-shaped pouring region.
Figure 6:
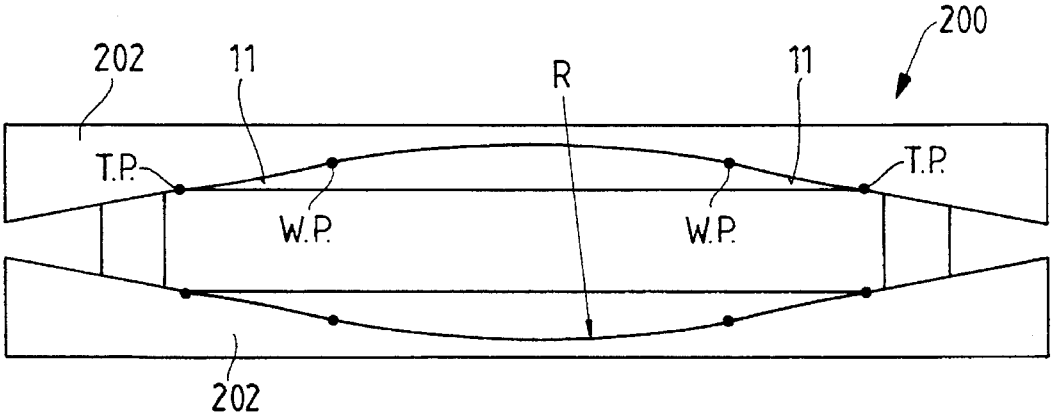
FIG. 6 is a top view of a metal mold having a wide side wall shown in FIG. 5.

Yet another embodiment of a wide side wall according to the instant invention, is shown in FIGS. 5 and 6. In this embodiment, wall portions located between the arcuate section 6, which defines the pouring region 4 and the inclined surfaces 7, are concave and comprise surfaces 11 bent with respect to the arcuate section 6, as can clearly be seen in FIG. 6.

Thus, the metal mold 200 is provided, in the space closed by a mold wall, with turning points W.P. The wide side wall of this embodiment is characterized by a small radius R and a large funnel opening size y.

It is common for all of the embodiments of a wide side wall and a metal mold according to the present invention, without discussing it for the embodiments of FIGS. 3, 4 and 5, 6, that, with the closed mold 1, 100 or 200, the changing of the dimensions is effected in a manner discussed with reference to FIGS. 1, 2*a* and 2*b*, namely, by adjusting the distance between parallel narrow side wall 3, whereby the width and the thickness is changed. The shape of the narrow and wide side walls insures that the shape of the castings, which are cast in the molds 1, 100, 200, corresponding to the narrow side region or the border region, does not change.

Though the present invention was shown and described with references to preferred embodiments, various modifications thereof will be apparent to those skilled in the art and, therefore, it is not intended that the invention be limited to the disclosed embodiments and/or details thereof, and departures may be made therefrom within the spirit and scope of the appended claims.

What is claimed is:

1. A metal mold for continuous casting of steel bands, comprising:

opposite wide side walls; and opposite narrow side walls extending parallel to each other between said opposite wide side walls and displaceable toward and away from each other;

wherein said opposite wide side walls have each a concave arcuate wall section defining a funnel-shaped pouring region which reduces dimension of a cast steel band toward said narrow side walls and in a casting direction, and opposite end surfaces extending from opposite sides of said concave arcuate wall section toward said narrow side walls and inclined in a direction toward said narrow side walls so that respective inclined end surfaces of said opposite wide side walls approach each other as they approach respective narrow side walls, and wherein said narrow side walls have each opposite surfaces complementary to the respective inclined end surfaces of said opposite wide side walls and abutting same, whereby a thickness of a cast steel band is changed upon displacement of said narrow side walls toward and away from each other.

2. A metal mold as set forth in claim 1, wherein the respective inclined end surfaces of the opposite wide side walls extend tangentially to respective concave arcuate wall sections of said opposite wide side walls and are connected to the respective concave arcuate wall sections of said opposite wide side walls at opposite tangent points, and wherein the opposite tangent points of one of the opposite wide side walls lie above respective ones of the opposite tangent points of another of the opposite side walls in a direction transverse to the cast direction.

3. A metal mold as set forth in claim 1, wherein the wide side wall has a flat wall portion located beneath the arcuate wall portion.

4. A metal mold as set forth in claim 1, further comprising further concave wall portions located between the inclined side surfaces and the concave arcuate wall portion.

5. A metal mold as set forth in claim 1, wherein the inclined surfaces have an inclination angle up to 10°.

* * * * *